US007771191B2

(12) United States Patent
Johnston et al.

(10) Patent No.: US 7,771,191 B2
(45) Date of Patent: Aug. 10, 2010

(54) SAFETY MECHANISM FOR A TORCH

(75) Inventors: Michael R. Johnston, Troutman, NC (US); Thomas A. Burdsall, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 268 days.

(21) Appl. No.: 11/561,064

(22) Filed: Nov. 17, 2006

(65) Prior Publication Data

US 2007/0281262 A1 Dec. 6, 2007

Related U.S. Application Data

(60) Provisional application No. 60/809,711, filed on May 31, 2006.

(51) Int. Cl.
*F23D 11/36* (2006.01)
*F23Q 1/04* (2006.01)

(52) U.S. Cl. ..... 431/153; 431/254; 431/255; 431/344

(58) Field of Classification Search ..... 431/153, 431/255, 254, 344
See application file for complete search history.

(56) References Cited

U.S. PATENT DOCUMENTS

| | | | | |
|---|---|---|---|---|
| 2,068,422 | A | 1/1937 | Lotz | |
| 2,206,709 | A | 7/1940 | Suits | |
| 2,477,837 | A | 8/1949 | Strom | |
| 3,247,423 | A | 4/1966 | Nolta et al. | |
| 3,275,060 | A | 9/1966 | Lindgren et al. | |
| 3,588,302 | A | 6/1971 | Herlan | |
| 4,011,426 | A | 3/1977 | Lange | |
| 4,220,443 | A | 9/1980 | Bear | |
| 4,348,172 | A * | 9/1982 | Miller | 431/255 |
| 4,473,859 | A | 9/1984 | Stone et al. | |
| 4,620,122 | A | 10/1986 | Howell | |
| 4,717,796 | A | 1/1988 | Howell | |
| 4,832,596 | A | 5/1989 | Morris, Sr. | |

(Continued)

FOREIGN PATENT DOCUMENTS

DE 19530325 C5 8/1995

(Continued)

OTHER PUBLICATIONS

Search Report, GB Patent Application No. 0708273.8, dated Dec. 24, 2007.

(Continued)

*Primary Examiner*—Kenneth B Rinehart
*Assistant Examiner*—Chuka C Ndubizu
(74) *Attorney, Agent, or Firm*—Dennis J. Williamson; Moore & Van Allen, PLLC

(57) ABSTRACT

A device for creating an electrical potential, such as a piezoelectric igniter, is connected to a conductor that conducts current to a burn tube to create a spark that ignites the fuel in the burn tube. The safety mechanism disables the operative connection between the trigger and the igniter such that the safety mechanism does not lock the trigger (the trigger may move relative to the torch body) but the movement of the trigger does not actuate the igniter. An actuating button is provided such that the user manually controls the position of the disabling mechanism.

8 Claims, 6 Drawing Sheets

U.S. PATENT DOCUMENTS

| | | | | |
|---|---|---|---|---|
| 4,904,180 | A | 2/1990 | Nitta | |
| 5,326,256 | A | 7/1994 | Shike et al. | |
| 5,496,169 | A | 3/1996 | Chen | |
| 5,655,901 | A | 8/1997 | Makoto | |
| 5,697,775 | A | 12/1997 | Saito et al. | |
| 5,743,724 | A | 4/1998 | Mifune et al. | |
| 5,897,308 | A | 4/1999 | Saito et al. | |
| 5,975,888 | A | 11/1999 | Hsu | |
| 6,042,367 | A | 3/2000 | Saito et al. | |
| 6,065,958 | A | 5/2000 | Adams et al. | |
| 6,093,017 | A | 7/2000 | Saito et al. | |
| 6,168,420 | B1 | 1/2001 | Sung | |
| 6,186,773 | B1 | 2/2001 | Sung | |
| 6,196,833 | B1 | 3/2001 | Ho | |
| 6,241,511 | B1 | 6/2001 | Hsu | |
| 6,315,550 | B1 | 11/2001 | Sher | |
| 6,336,807 | B1 | 1/2002 | Hsu | |
| 6,439,879 | B1 | 8/2002 | Hsu | |
| 6,682,340 | B2 | 1/2004 | Kim | |
| 6,692,248 | B2 | 2/2004 | Huang et al. | |
| 6,722,877 | B2 * | 4/2004 | Wang et al. | 431/153 |
| 6,765,338 | B2 | 7/2004 | Orazietti | |
| 6,867,955 | B2 | 3/2005 | Chou et al. | |
| 6,940,234 | B2 | 9/2005 | Chou et al. | |
| 6,997,700 | B2 | 2/2006 | Kim | |
| 7,244,120 | B2 * | 7/2007 | Jiang | 431/153 |
| 2003/0022120 | A1 | 1/2003 | Liang | |
| 2003/0124476 | A1 | 7/2003 | Yang | |

FOREIGN PATENT DOCUMENTS

| | | | |
|---|---|---|---|
| DE | 20003449 | U1 | 2/2000 |
| EP | 0488158 | A2 | 11/1991 |
| GB | 2404723 | | 2/2005 |
| GB | 2404723 | A * | 2/2005 |
| GB | 2416023 | | 1/2006 |
| WO | 9208931 | | 5/1992 |
| WO | 0052390 | | 9/2000 |

OTHER PUBLICATIONS

Search Report, GB Patent Application No. 0708873.5, dated Sep. 1, 2007.

German Patent Office, Office Action, Jun. 3, 2009.

* cited by examiner

SAFETY MECHANISM FOR A TORCH

This application claims the benefit of priority under 35 U.S.C. §119(e) to the filing date of U.S. Provisional Application 60/809,711 filed on May 31, 2006, which is incorporated herein by reference in its entirety.

BACKGROUND OF THE INVENTION

The invention relates to self-igniting torches and lighters such as propane, butane, mixed gas or MAPP fueled torches and butane lighters that use a source of fuel that is ignited by a spark generated by, for example, a piezoelectric igniter (collectively "torches"). Such torches are used for heating, brazing, welding and the like and such lighters are commonly used in household applications for lighting fireplaces, grills and the like.

Self-igniting torches and lighters typically include a trigger or push button ignition that when depressed, releases a flow of fuel under pressure into a burn tube and simultaneously activates the igniter to create a spark that ignites the fuel in the burn tube. The ignited fuel creates a steady flame at the end of the burn tube that can be used in a variety of heating/lighting applications.

Safety standards for lighters to prevent the unsafe ignition of these devices such as by a child are set forth in 16 C.F.R. §1212. To comply with the safety standards one solution uses a mechanical lock that locks the trigger or push button into an "off" position such that the trigger cannot be depressed and the torch cannot be ignited. The torch or lighter may only be ignited if the mechanical trigger lock is unlocked allowing the trigger to be depressed.

The present invention provides an alternative mechanism for preventing the unsafe operation of a torch or lighter that interrupts the flow of electricity from the igniter to the burn tube to thereby prevent ignition of the fuel.

SUMMARY OF THE INVENTION

The present invention provides an alternative mechanism for preventing the unsafe operation of a torch or lighter that interrupts the flow of electricity from the igniter to the burn tube to thereby prevent ignition of the fuel. A device for creating an electrical potential, such as a piezoelectric igniter, is connected to a conductor that conducts current to a burn tube to create a spark that ignites the fuel in the burn tube. The safety mechanism comprises a mechanism for disabling the operative connection between the trigger and the igniter such that the safety mechanism does not lock the trigger (the trigger may move relative to the torch body) but the movement of the trigger does not actuate the igniter. An actuating button is provided such that the user manually controls the position of the disabling mechanism.

DETAILED DESCRIPTION OF EMBODIMENTS OF THE INVENTION

A typical torch or lighter consists of a fuel source such as butane, propane, mixed gas or MAPP gas held under pressure in a fuel container. In a torch, the fuel container may be a tank or canister releasably connected to the torch body such that the fuel supply can be removed when empty and replaced. In a lighter, the fuel container may be a relatively small plastic receptacle that is formed as an integral part of the lighter and the lighter may be either refilled or disposed of when the fuel supply is empty. The fuel supply is connected to a fuel supply system that transports the fuel to a burn tube where it is ignited. In a torch the fuel container, fuel supply system (such as regulator and control valves) and burn tube may comprise separate components that are connected together such that the fuel containers may be removed and replaced and different burn tubes for different applications may be used. In simpler and less expensive lighters the fuel supply, burn tube and fuel supply system may form part of a single device that is intended to be disposed of after the fuel is depleted. The safety mechanism of the invention has application in either type of system.

Figure 1:
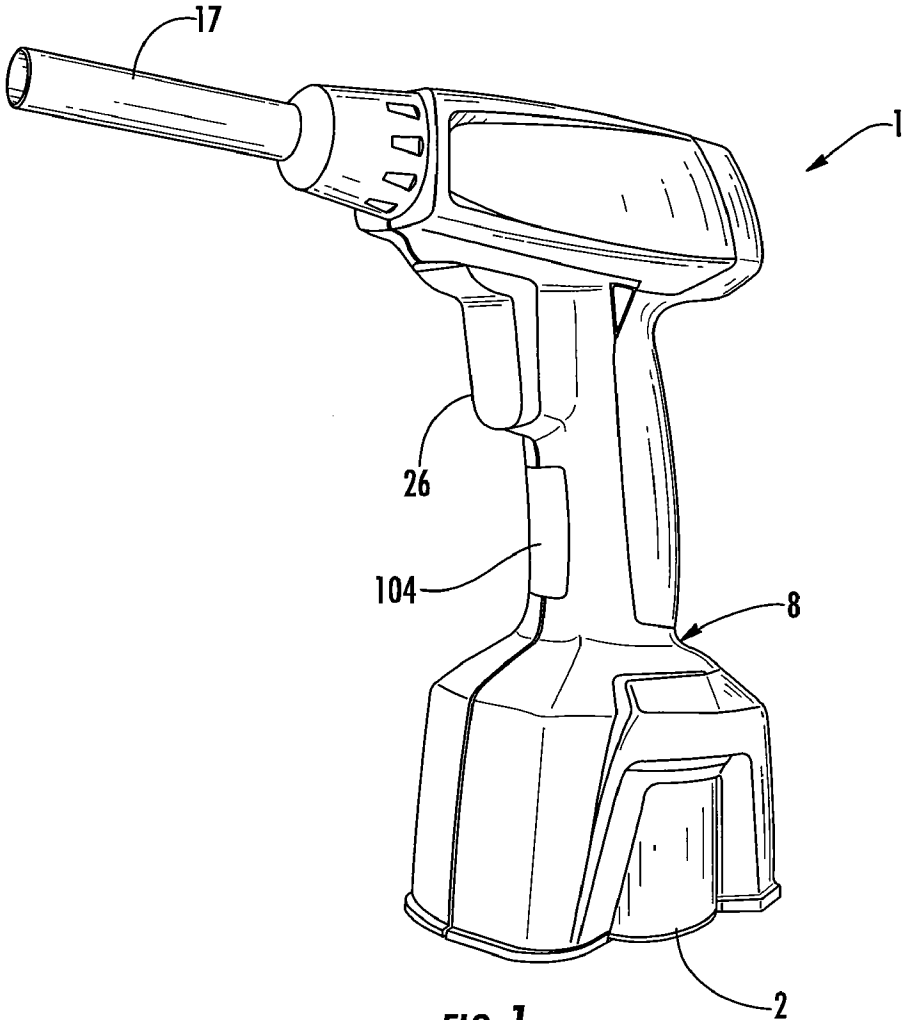
FIG. 1 is a perspective view of one embodiment of a torch that uses the safety mechanism of the invention.
Figure 2:
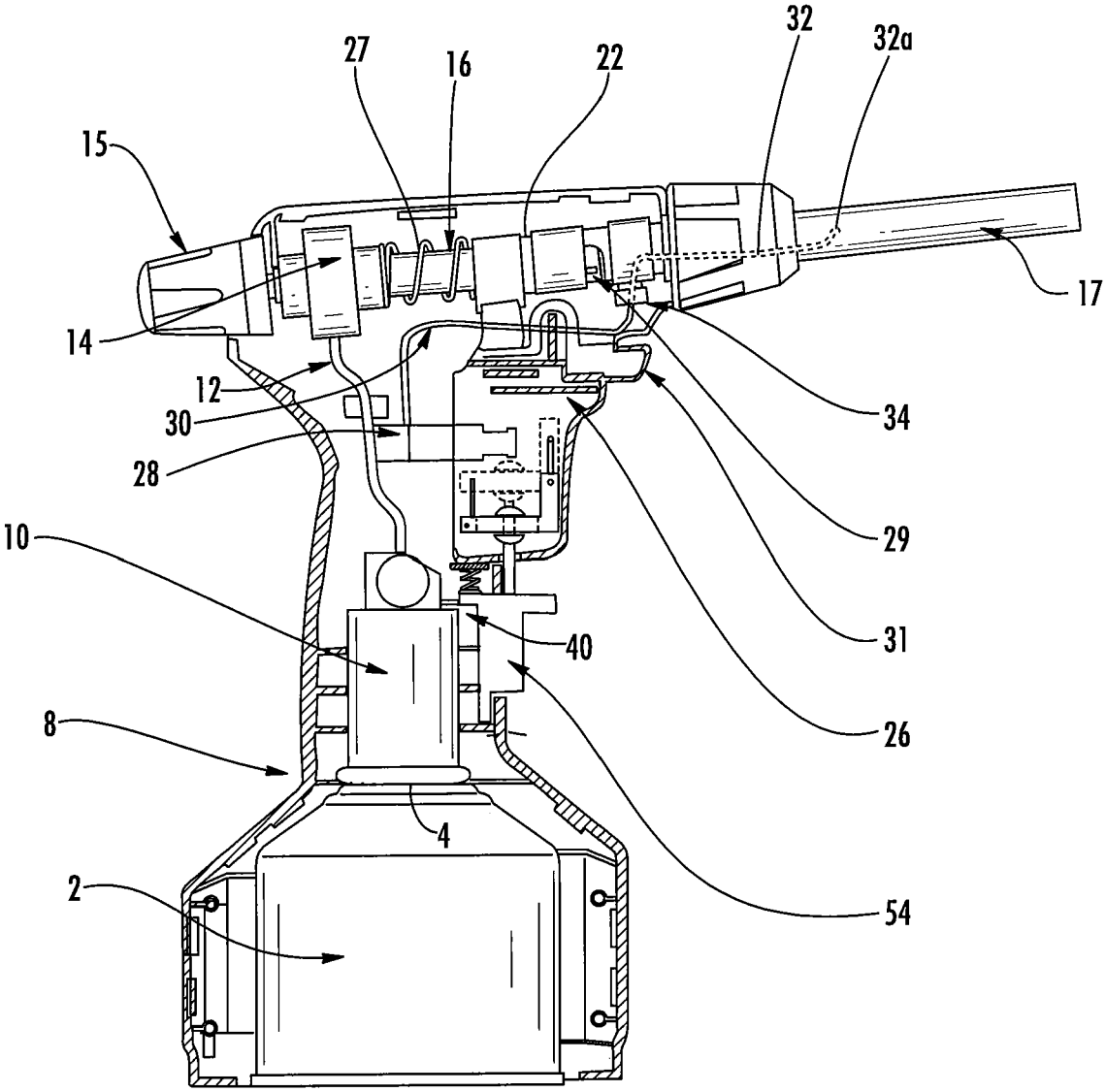
FIG. 2 is a side view of one embodiment of a torch of the invention with a portion of the torch body removed to show the internal components of the torch.

Example embodiments of a torch 1 employing the safety mechanisms of the invention are shown in the FIGS. 1 and 2 and consist of a canister 2 for holding a supply of fuel. The canister 2 may be formed with screw threads or other releasable connector adjacent the canister's inlet/outlet port 4 to connect the canister to the torch body 8 of the fuel supply system.

The torch body 8 may contain each of the components of the fuel supply system in an integral unit or the components may be releasably secured to the torch body such that the components may be replaced. The typical fuel supply system for a torch may include a regulator 10 for regulating the flow of fuel from tank 2 such that the fuel enters the fuel supply system under a constant pressure; however, a regulator is not required for the torch. If a regulator is used, the regulator 10 may include a spring loaded diaphragm or piston that provides a flow of fuel under a constant pressure to avoid pressure variations that may occur due to variations in temperature, elevation or the like. A fuel supply line 12 connects the regulator to a gas valve 14 such that the fuel flowing from regulator 10 is delivered to the input port of the gas valve 14. The output port of the gas valve 14 is connected to fuel supply line 16. Typically, a manually actuated flow control such as knob 15 is used to open or close the gas valve 14 and control the flow of fuel to the burn tube 17. By manipulating control 15, a user can control the size/heat of the flame generated by the torch. Valve 14 and control 15 may be eliminated if control of the flame size is not required. Fuel supply line 16 terminates in an orifice 18 that receives burn tube 17 such that gas exiting orifice 18 flows under pressure through the burn tube 17.

To release the fuel through orifice 18 and into burn tube 17 a valve 22 is located in gas supply line 16 that is actuated by a push button/trigger 26. When trigger 26 is depressed valve 22 is opened to allow the fuel to flow through venturi 29 and into fuel supply line 16, out of orifice 18 and into burn tube 17. A spring 27 returns the valve to the closed position when the trigger is released. Trigger 26 also actuates piezoelectric igniter 28 when the trigger is depressed such that a spark is created in the burn tube 17 simultaneous with, or just after, the flow of gas through the burn tube. A trigger lock 29 may also be provided to mechanically lock the trigger in the depressed position to allow "hands-free" operation of the torch such that the torch will produce a flame without the user having to continually depress the trigger 26.

To create the spark, trigger 26 is mechanically connected to piezoelectric igniter 28 that is connected to an electrical conductor such as a wire 30. One end of piezoelectric igniter 28 may be in electrically conductive contact with the fuel supply line 12 in order to complete the electrical circuit. Due to the size of the charge used, the igniter 28 does not have to actually touch the fuel line because arcing can occur if a small gap exists between the igniter and the fuel supply line 12. Rather than using the fuel supply line 12 to complete the circuit, wires may be used to complete the circuit. Fuel supply line 12 is made of electrically conductive material such as brass, copper or the like. Wire 30 extends to the connector 34 where it mechanically engages an electrical conductor 32 that extends into burn tube 17. In the illustrated embodiment releasable connector 34 electrically connects conductor 30 to conductor 32 to create an electrical path between the piezoelectric igniter 28 and the inside of burn tube 17 to allow the burn tube to be removed from the valve body. Connector 34 may be omitted and a single electrical conductor may extend from the torch body and into the burn tube.

To create the spark in the burn tube 17, piezoelectric igniter 28 is actuated by depressing trigger 26. The end 32*a* of electrical conductor 32 is positioned in burn tube 17 such that it is spaced from the burn tube a distance such that arcing occurs between the end of the conductor 32*a* and the interior surface of burn tube 17 to create a spark that ignites the fuel/air mixture flowing through the burn tube.

The safety mechanism of the invention comprises a mechanism for disabling the operative connection between the trigger and the igniter such that the safety mechanism does not lock the trigger (the trigger may move relative to the torch body) but the movement of the trigger does not actuate the igniter. In one embodiment illustrated in FIG. 3 the safety mechanism includes a pair of tracks 40 and 42 located within the trigger 26. While two tracks are illustrated, a greater or lesser number of tracks may be used. The tracks may consist of grooves located on the inside opposite walls of the trigger 26. An actuator bar 44 is supported for movement in tracks 40 and 42 by pins 47 and 49 such that the actuator bar can reciprocate in the trigger in the direction of arrow A. Other mechanisms for allowing the reciprocating motion of actuator bar 44 relative to trigger 26 may also be used. The actuator bar 44 has an L-shaped configuration where one arm 44*a* of the actuator bar is moved between a first position (shown in dashed lines) where it is located between igniter 28 and trigger 26 and a second position (shown in solid lines) where it is displaced from between the igniter and trigger. The opposite arm 44*b* of the actuator has a slot 46 formed therein for receiving a drive member 48. While the actuator bar has been described as having an L-shape it is to be understood that it may have any shape provided that it can be movably positioned between the igniter and trigger.

The drive member 48 is dimensioned such that it is slidably received in slot 46. Drive member 48 is provided with flanges 50 and 52 that allow the actuator bar to move relative to the drive member in the direction of arrow B but constrain movement between the actuator bar and the drive member in the direction of arrow A. The drive member 48 is secured to an actuating switch 54 that is mounted on the torch body 8 such that actuating switch 54 can reciprocate relative to the torch body in the direction of arrow A. Movement of switch 54 moves actuator bar 44 between the solid line and dashed line positions of FIG. 3. Switch 54 is located on the torch body such that it is accessible by the user when holding the torch. In one embodiment the switch 54 is a push button that is located on the torch body such that it can be depressed by a user's fingers when the user depresses the trigger 26 with fingers of the same hand. The switch may also be located at the rear of the body 8 such that it can be depressed by a user's thumb when the user depresses trigger 26 with fingers of the same hand. The switch may be located in other positions where either one or two handed operation is possible. A spring 56 biases switch 54 away from igniter 28 such that the actuator bar 44 normally assumes the solid line position of FIG. 3.

Figure 3:
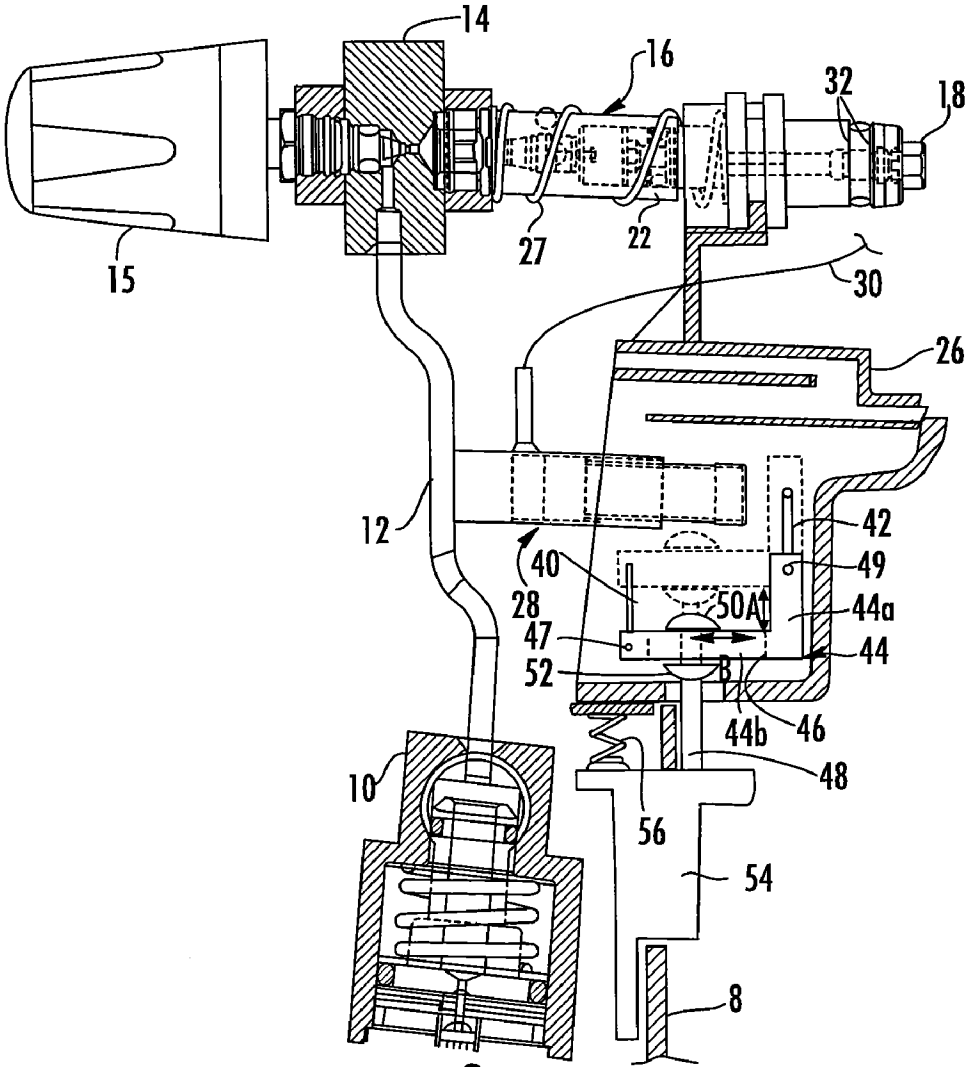
FIGS. 3 through 7 are views of the internal structure of various embodiments of a torch of the invention.

In operation when the actuator bar 44 is in the solid line "safety" position of FIG. 3, the torch cannot be ignited. When the drive member is in this position and the trigger is depressed, the space between the igniter 28 and trigger 26 is great enough such that the trigger does not contact the igniter when it is depressed. To generate a flame, the switch 54 is moved upward as viewed in FIG. 3 and the engagement of drive member 48 with actuator bar 44 moves the actuator bar to the dashed line position of FIG. 3. In this position the actuator bar is located between trigger 26 and igniter 28 such that when the trigger is depressed the trigger contacts actuator bar 44 and moves actuator bar 44 into engagement with igniter 28 to actuate igniter and generate a spark in the burn tube. Actuator bar 44 is able to move with the trigger in this position because of the sliding engagement between drive member 48 and slot 46. When the trigger 26 is released, the actuator bar is returned to the "safety" position by spring 54 where depressing the trigger will not ignite the fuel in the burn tube.

When trigger 26 is released the flow of fuel stops due to the closing of valve 22. The torch can only be reignited by again actuating switch 54 and trigger 26. Typically, switch 54 is actuated and held prior to actuating trigger 26. If switch 54 is not actuated, trigger 26 can still be depressed, however, the torch will not ignite because no electrical current flows to the burn tube 17.

Figures 4, 5:
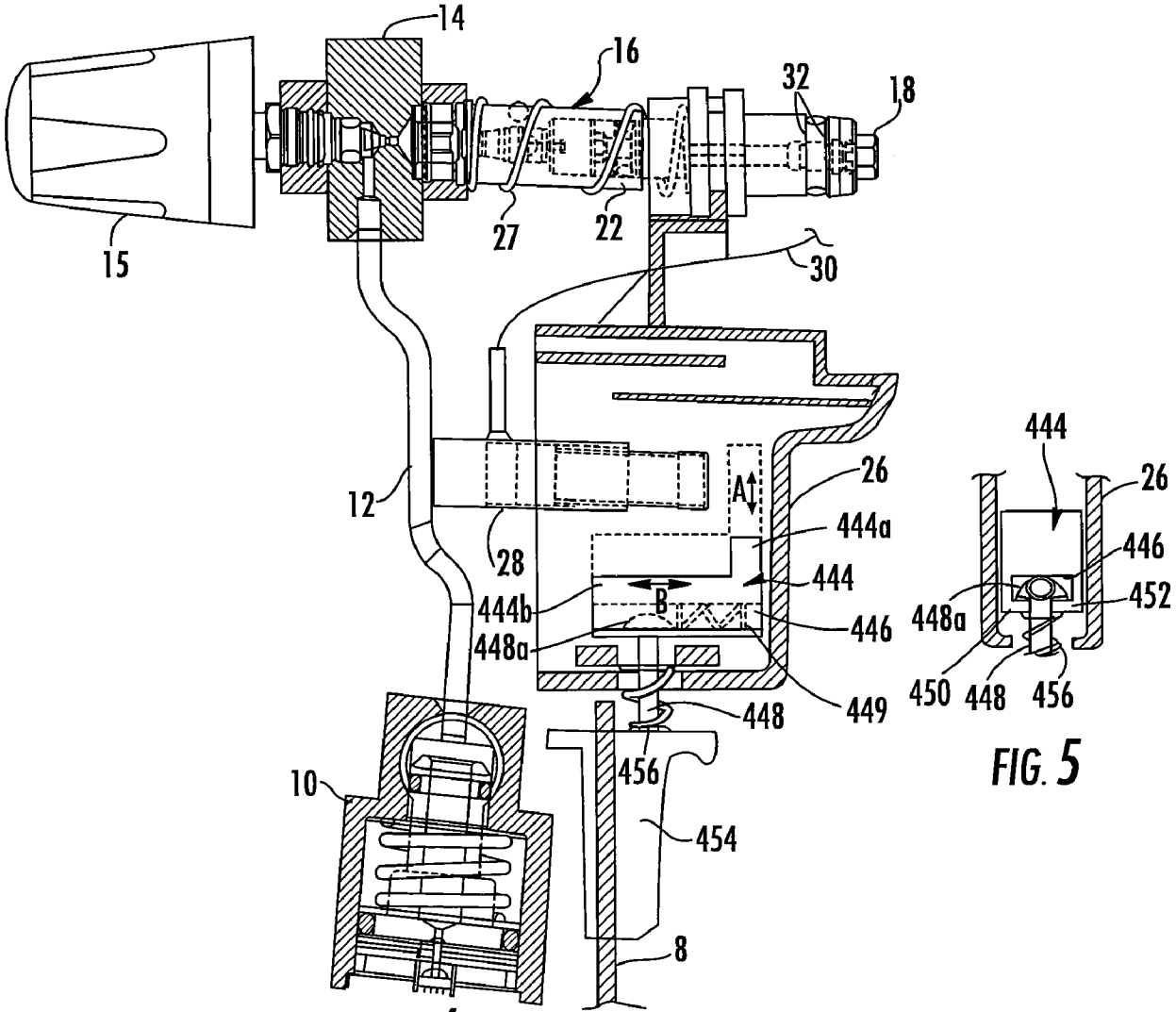

An alternate embodiment of the invention is shown in FIGS. 4 and 5 where like reference numerals are used to describe like components previously described with reference to the embodiment of FIG. 3. An actuator bar 444 is supported for movement in trigger 26 such that the actuator bar can reciprocate in the trigger in the direction of arrow A. The actuator bar 444 has an L-shaped configuration where one arm 444*a* of the actuator bar is moved between a first position (shown in dashed lines) where it is located between igniter 28 and trigger 26 and a second position (shown in solid lines) where it is displaced from between the igniter and trigger. The opposite arm 444*b* of the actuator has a channel 446 formed therein for slidably receiving the head 448*a* of drive member 448. While the actuator bar has been described as having an L-shape it is to be understood that it may have any shape provided that it can be movably positioned between the igniter and trigger.

The head 448*a* of drive member 448 is dimensioned such that it is slidably received in channel 446. Channel 446 is provided with flanges 450 and 452 that allow the actuator bar to move relative to the drive member in the direction of arrow B but constrain movement between the actuator bar 448 and the drive member 444 in the direction of arrow A. The drive member 448 is secured to an actuating switch 454 that is mounted on the torch body 8 such that actuating switch 454 can reciprocate relative to the torch body in the direction of arrow A. Movement of switch 454 moves actuator bar 444 between the solid line and dashed line positions of FIG. 4. A spring 456 biases switch 454 away from igniter 28 such that the actuator bar 444 normally assumes the solid line "safety" position of FIG. 4.

In operation when the actuator bar 444 is in the solid line safety position shown in FIG. 4, the torch cannot be ignited. When the actuator bar 444 is in this position and the trigger 26 is depressed, the space between the igniter 28 and trigger 26 is great enough such that the trigger does not contact the igniter. To generate a flame, the switch 454 is moved upward as viewed in FIG. 4 and the engagement of drive member 448 with actuator bar 444 moves the actuator bar to the dashed line position of FIG. 4. In this position the leg 444*a* of actuator bar 444 is located between trigger 26 and igniter 28 such that when the trigger is depressed the trigger contacts actuator bar 444 and moves actuator bar 444 into engagement with igniter 28 to actuate igniter and generate a spark in the burn tube. Actuator bar 444 is able to move with the trigger in this position because of the sliding engagement between head 448*a* of drive member 448 and channel 446. When the trigger 26 is released, the actuator bar returns to the "safety" position where depressing the trigger will not ignite the fuel in the burn tube. A spring 449 returns the actuator bar and trigger to the position of FIG. 4.

Figure 6:
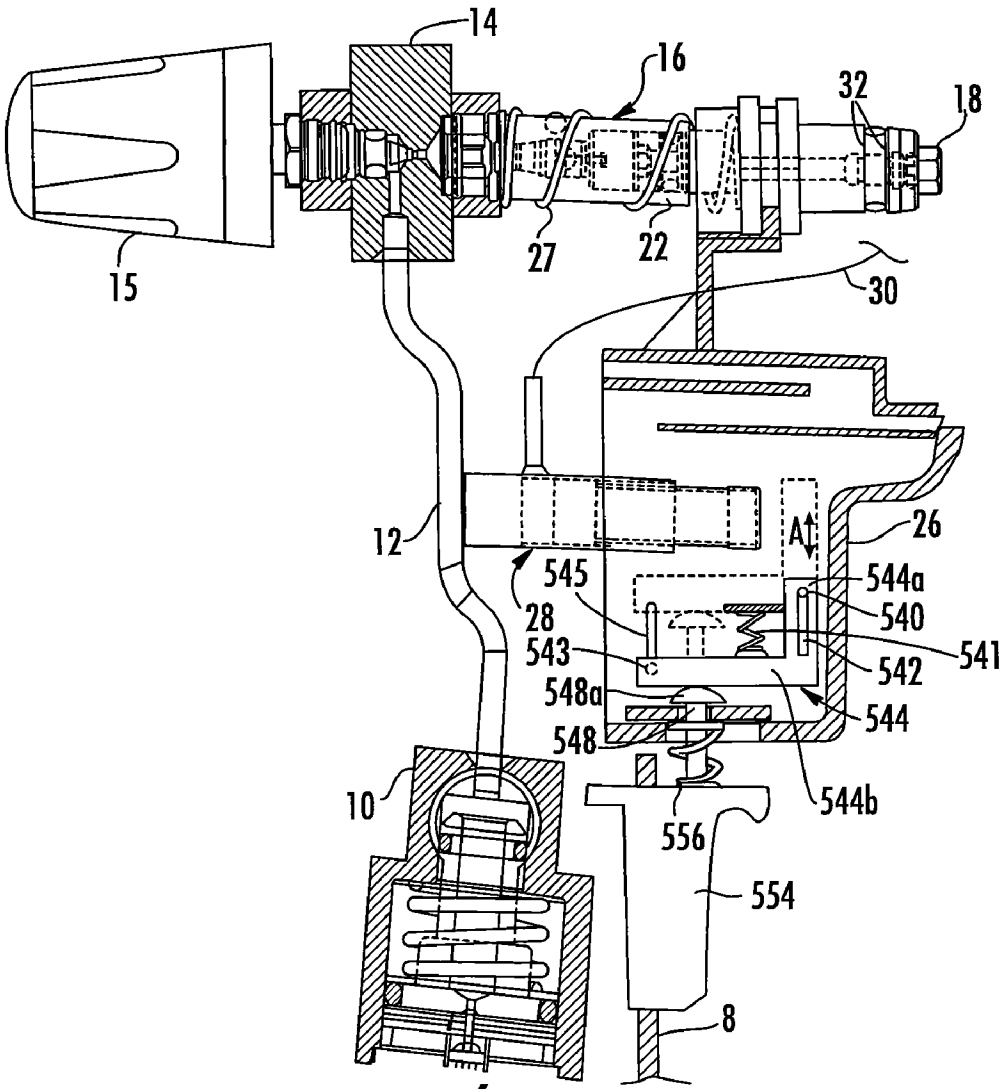

An alternate embodiment of the invention is shown in FIG. 6 where like reference numerals are used to describe like components previously described with reference to the embodiment of FIG. 3. The safety mechanism includes a pin 540 fixed within the trigger 26. An actuator bar 544 includes a track 542 that is engaged by pin 540 such that the actuator bar can reciprocate within in the trigger in the direction of arrow A. The actuator bar 544 may also include a pin 543 that rides in a slot 545 formed on trigger 26. Pin 540 may be replaced by protrusions formed on the trigger that engage track 542. The actuator bar 544 has an L-shaped configuration where one arm 544*a* of the actuator bar is moved between a first position (shown in dashed lines) where it is located between igniter 28 and trigger 26 and a second position (shown in solid lines) where it is displaced from between the igniter and trigger. The opposite arm 544*b* of the actuator slidably rests on the head 548*a* of drive member 548. While the actuator bar 544 has been described as having an L-shape it is to be understood that it may have any shape provided that it can be movably positioned between the igniter and trigger.

The drive member 548 is secured to an actuating switch 554 that is mounted on the torch body such that actuating switch 554 can reciprocate relative to the torch body 8 in the direction of arrow A. Movement of switch 554 moves actuator bar 544 between the solid line and dashed line positions of FIG. 6. A spring 556 biases switch 554 and a spring 541 biases actuator bar 544 downward as viewed in FIG. 6 such that the actuator bar 544 normally assumes the solid line position of FIG. 6.

In operation when the actuator bar 544 is in the solid line "safety" position of FIG. 6, the torch cannot be ignited. When the drive member is in this position and the trigger 26 is depressed, the space between the igniter 28 and trigger 26 is great enough such that the trigger does not contact the igniter when it is depressed. To generate a flame, the switch 554 is moved upward as viewed in FIG. 6 and the engagement of drive member 548 with actuator bar 544 moves the actuator bar to the dashed line position. In this position the actuator bar is located between trigger 26 and igniter 28 such that when the trigger is depressed the trigger contacts actuator bar 544 and moves actuator bar 544 into engagement with igniter 28 to actuate igniter and generate a spark in the burn tube. Actuator bar 544 is able to move with the trigger in this position because of the sliding engagement between drive member 544 and head 548*a* of drive member 548. When the trigger 26 is released, the actuator bar is returned to the "safety" position by spring 556 where depressing the trigger will not ignite the fuel in the burn tube.

Figure 7:
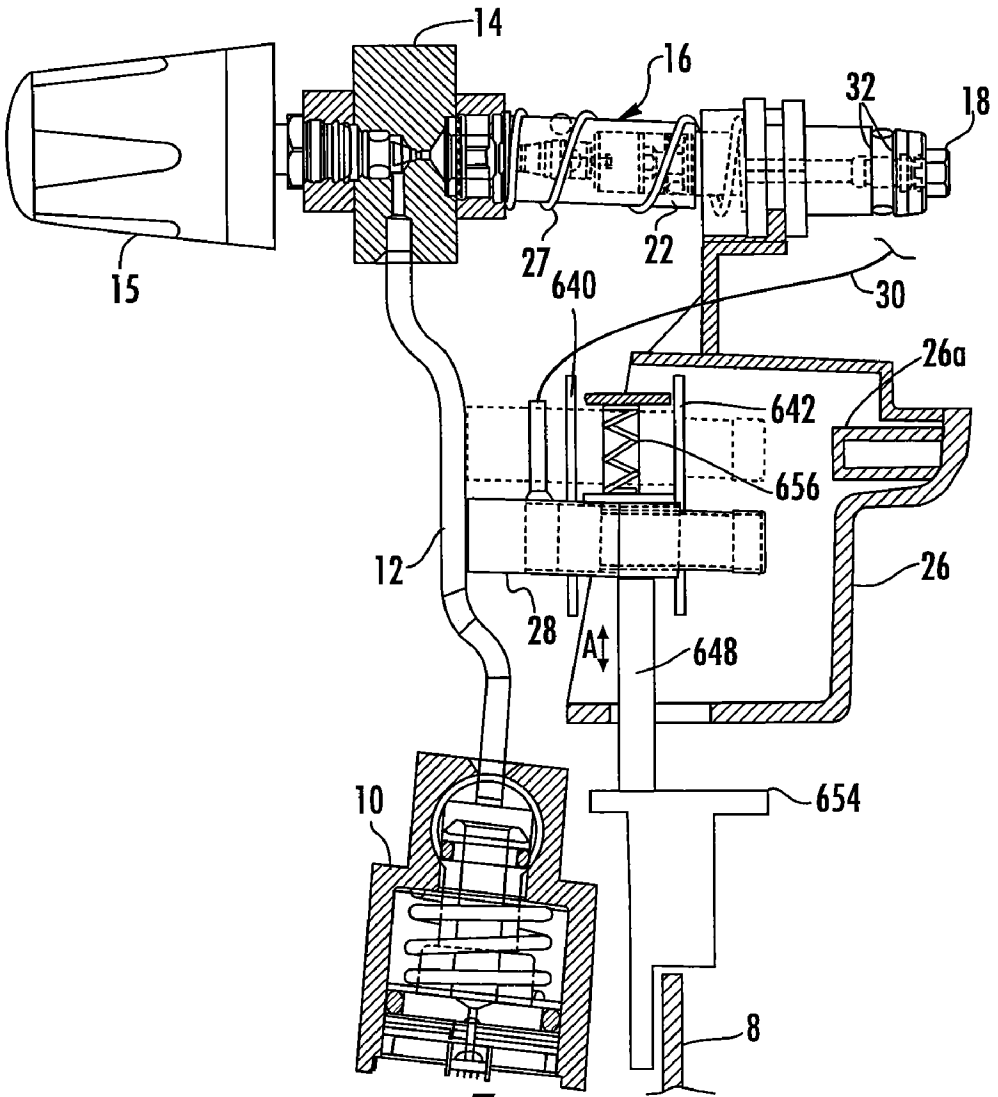

An alternate embodiment of the invention is shown in FIG. 7 where like reference numerals are used to describe like components previously described with reference to the embodiment of FIG. 3. The safety mechanism includes a pair of tracks 640 and 642 fixed within the torch body 8 adjacent trigger 26. The tracks may consist of plates fixed to the inside opposite walls of the torch body and having through holes for receiving and slidably supporting the igniter 28.

A drive member 648 is secured to an actuating switch 654 that is mounted on the torch body 8 such that actuating switch 654 can reciprocate relative to the torch body in the direction of arrow A. Movement of switch 654 moves drive member 648 to move the igniter 28 in tracks 640 and 642 between the solid line position and dashed line position of FIG. 7. A spring 656 biases igniter 28 such that when switch 654 is released the igniter is moved to the solid line position of FIG. 7. A projection 26*a* is formed on trigger 26 that contacts igniter 28 when the igniter is in the dashed line position to actuate the igniter and initiate generation of a spark in the burn tube.

In operation when the igniter 28 is in the solid line "safety" position of FIG. 7, the torch cannot be ignited. When the igniter 28 is in this position and the trigger 26 is depressed, the igniter 28 is offset from projection 26*a* such that the trigger does not contact the igniter when it is depressed. To generate a flame, the switch 654 is moved upward as viewed in FIG. 7 and the engagement of drive member 648 with igniter 28 moves the igniter to the dashed line position. In this position the igniter 28 is located adjacent the projection 26*a* such that when the trigger 26 is depressed the projection 26*a* contacts igniter 28 to actuate igniter and generate a spark in the burn tube. When the trigger 26 is released, the actuator bar returns to the "safety" position by spring 656 where depressing the trigger will not ignite the fuel in the burn tube.

While embodiments of the invention are disclosed herein, various changes and modifications can be made without departing from the spirit and scope of the invention. One of ordinary skill in the art will recognize that the invention has other applications in other environments. Many embodiments are possible. The following claims are in no way intended to limit the scope of the invention to the specific embodiments described above.

The invention claimed is:

1. A torch comprising: a burn tube for receiving a flow of fuel; an igniter having a body and a movable plunger for creating an electric potential; means for creating a spark in the burn tube to ignite the fuel; a trigger for actuating the igniter movable between a first extended position and a second fully retracted position; the igniter body mounted for movement in said torch between a first position and a second position; an actuating switch for moving the igniter body between said first position and said second position, said igniter body when in the first position is positioned such that said plunger is engaged by the trigger when the trigger is moved from the first extended position to the second fully retracted position such that the igniter is actuated, and said igniter body when in the second position is spaced from the trigger such that as the trigger moves from said first extended position to said second fully retracted position the trigger does not contact the plunger such that actuation of the igniter is disabled.

2. The safety mechanism for a torch of claim 1 wherein said igniter is moved into said first position manually.

3. The safety mechanism for a torch of claim 1 wherein said igniter is biased to said second position.

4. The safety mechanism for a torch of claim 3 wherein said igniter is biased to said second position by a spring.

5. A torch comprising: a burn tube for receiving a flow of fuel; an igniter for creating an electric potential; a trigger for actuating the igniter movable between a first extended position and a second fully retracted position; an actuator bar movable in a first direction between a first position and a second position, said actuator bar having a first portion that when in the first position is positioned between the trigger and the igniter and is moved into engagement with the igniter by the trigger to actuate the igniter as the trigger moves from the first extended position to the second fully retracted position, and said actuator bar when in the second position creates a space between the igniter and the first portion of the actuator bar such that as the trigger moves from said first extended position to said second fully retracted position the trigger and actuator bar do not contact the igniter such that actuation of the igniter is disabled; and a drive member operatively connected to the actuator bar, said drive member positioned in a slot formed in the actuator bar such that the actuator bar can move relative to the drive member in the slot along a second direction perpendicular to the first direction such that the actuator bar moves relative to the drive member as the trigger moves between the first position and the second position.

6. The torch of claim 5 wherein a spring is located in the slot to bias the trigger to the first extended position.

7. The torch of claim 5 wherein the actuator bar engages tracks formed in the trigger.

8. The torch of claim 5 wherein the actuator bar is substantially L-shape having a first leg and a second leg, said first leg defining said slot and the second leg defining the first portion.

* * * * *